US007551886B2

(12) United States Patent
Kida et al.

(10) Patent No.: US 7,551,886 B2
(45) Date of Patent: Jun. 23, 2009

(54) IMAGE FORMING DEVICE

(75) Inventors: Hiroshi Kida, Yamatokoriyama (JP); Tatsuya Inoue, Nara (JP); Yoshiharu Yoneda, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 10/463,584

(22) Filed: Jun. 18, 2003

(65) Prior Publication Data

US 2003/0231911 A1 Dec. 18, 2003

(30) Foreign Application Priority Data

Jun. 18, 2002 (JP) ..... 2002-177437

(51) Int. Cl.
*G03G 15/00* (2006.01)

(52) U.S. Cl. ..... 399/391; 271/9.01; 347/262; 347/264

(58) Field of Classification Search ..... 399/86, 399/81, 85, 196, 197, 391, 392; 271/3.01, 271/3.03, 3.08, 9.02, 9.03, 9.04, 9.09, 9.12; 347/264, 262

See application file for complete search history.

(56) References Cited

U.S. PATENT DOCUMENTS 4,967,240 A * 10/1990 Kitano et al. ..... 399/364
5,307,116 A * 4/1994 Ikunami et al. ..... 399/18
5,405,128 A 4/1995 Fujiwara et al.
5,624,108 A 4/1997 Kubo
5,678,138 A * 10/1997 Kobayashi et al. ..... 399/18
5,790,921 A * 8/1998 Ishikura et al. ..... 399/86
5,867,278 A * 2/1999 Takahashi et al. ..... 358/296
5,897,236 A * 4/1999 Hashimoto et al. ..... 399/8
5,926,684 A 7/1999 Horiuchi et al.
6,085,049 A * 7/2000 Tanigawa ..... 399/20
6,323,939 B1 11/2001 Suzuki et al.
6,616,135 B1 * 9/2003 Shida et al. ..... 270/58.08
6,739,778 B2 * 5/2004 Fuchi et al. ..... 400/693
6,751,426 B2 * 6/2004 Akiba et al. ..... 399/82
6,823,154 B2 * 11/2004 Koga et al. ..... 399/110
2002/0061206 A1 5/2002 Enomoto et al.
2003/0209850 A1 * 11/2003 Asao ..... 271/65

FOREIGN PATENT DOCUMENTS

JP 03205234 A * 9/1991
JP 5-97262 A 4/1993
JP 5-193768 A 8/1993
JP 05193766 A * 8/1993
JP 07206209 A * 8/1995
JP 7-277539 A 10/1995
JP 10087092 A * 4/1998
JP 2000-191160 A 7/2000
JP 2000-255911 A 9/2000
JP 2002037466 * 2/2002

* cited by examiner

*Primary Examiner*—Leslie J Evanisko
*Assistant Examiner*—Matthew G Marini
(74) *Attorney, Agent, or Firm*—Birch, Stewart, Kolasch & Birch, LLP

(57) ABSTRACT

An image forming device includes a first carriage path for carrying paper stored in a paper feeding tray to a printer, there is a second carriage path for carrying paper stored in a second paper feeding tray to the printer. The first carriage path and the second carriage path individually carry a paper to the printer.

33 Claims, 4 Drawing Sheets

IMAGE FORMING DEVICE

FIELD OF THE INVENTION

The present invention relates to an image forming device for forming an image on a recording medium, such as a photocopier, a printer, or a printing device, and particularly relates to an image forming device including a plurality of recording medium feeding sections for selectively supplying various types of recording medium.

BACKGROUND OF THE INVENTION

There have been various user demands for an image forming device, having a function for setting a large quantity of recording medium (papers) all at once, a function for setting various kinds of papers at the same time, or minimization of the installation area.

To meet such user demands, various paper feeding units have been conventionally created, and an image forming device which appropriately uses these various feeding units according to the use environment has been provided as an image forming system.

For example, Japanese Unexamined Patent Publication Tokukaihei 5-97262 (Published on Apr. 20, 1993) discloses an image forming device including an automatic paper feeding device which is made up of first and second cassettes for holding around 500 papers, and first and second decks for holding a large quantity of papers, i.e., more than 500 papers.

However, in the image forming device disclosed in the foregoing publication, sub carriage paths extending from the respective paper feeding sections are merged to a single main carriage path which is vertically provided on the right side of the image forming device. Namely, more merging points are required for connecting the main carriage path and the respective sub carriage paths in this device, and therefore the paper carriage path requires a complicated configuration. Thus, stable paper carriage cannot be ensured in this device.

SUMMARY OF THE INVENTION

The present invention provides an image forming device capable of carrying a recording medium without occurrence of medium jam in the carriage path of the device.

In order to solve the foregoing problems, the image forming device of the present invention for carrying out image forming by an image forming section with respect to a recording medium carried from a plurality of recording medium feeding sections, which includes: first and second carriage paths, the plurality of recording medium feeding sections including first and second recording medium feeding sections, and the first carriage path carrying a recording medium stored in the first recording medium feeding section to the image forming section; and the second carriage path carrying a recording medium stored in the second recording medium feeding section to the image forming section, and the first carriage path and the second carriage path individually carrying a recording medium to the image forming section.

More specifically, the image forming device of the present invention carries out image forming by an image forming section with respect to a recording medium carried from the first recording medium feeding section and the second recording medium feeding section. Here, when a recording medium carriage path from the first recording medium feeding section and a recording medium carriage path from the second recording medium feeding section are partly unified, the carriage path from one of the recording feeding sections has to be merged with the carriage path from another recording medium feeding section. Particularly, when a large number of recording medium feeding sections are provided, more merging points are required for merging the carriage paths from the respective recording medium feeding sections, thus causing complication of the carriage path structure. With such a structure complication of the recording medium carriage path, a recording medium jam may occur in the carriage path.

Therefore, the present invention particularly provide the first carriage path for carrying a recording medium stored in the first recording medium feeding section to the image forming section; and the second carriage path for carrying a recording medium stored in the second recording medium feeding section to the image forming section, and the first carriage path and the second carriage path individually carry a recording medium to the image forming section.

Namely, since the image forming device of the present invention is arranged so that the first carriage path and the second carriage path individually carry recording mediums to the image forming section, the carriage path extending from one of the recording medium feeding sections does not have to merge with the carriage path extending from another one of the recording medium feeding sections. Accordingly, the recording medium carriage path to the image forming section can be simplified and the recording medium jam in the carriage path can be reduced.

Further, even if the recording medium jam occurs in the first carriage path or in the second carriage path, the user can easily remove the recording medium caught therein, since each path is made as a simple structure without the merging point to each other.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of the present invention with reference to FIGS. 1 through 4.

Figure 1:
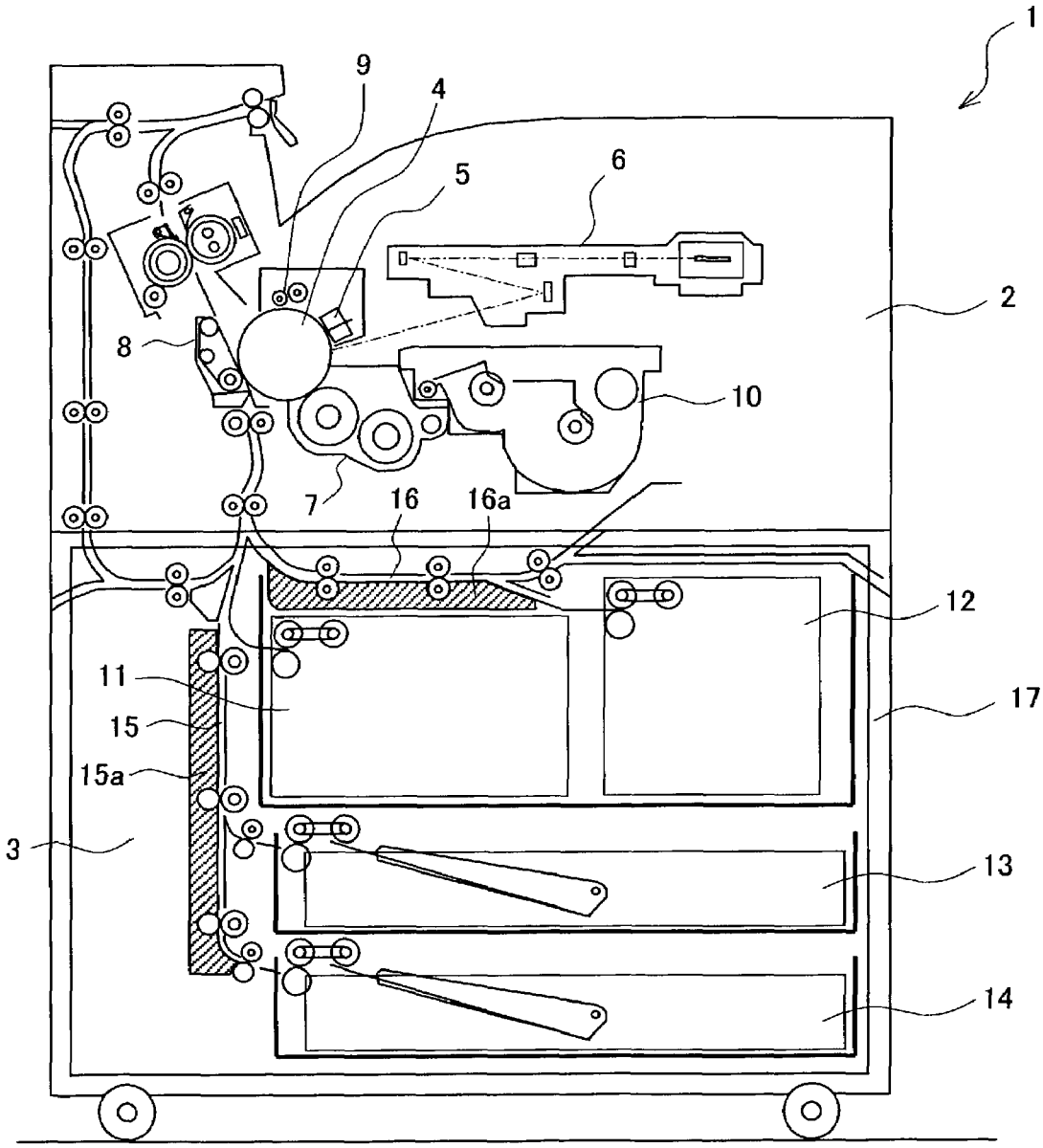
FIG. 1 is a cross-sectional view showing one embodiment of an image forming device according to the present invention.

As shown in FIG. 1, an image forming device 1 according to the present embodiment includes a printer (image forming section) 2, and a paper feeding unit 3 which is provided under the printer 2. Further, an electrophotography processing section including such as a photoconductive drum 4 is provided in substantially central portion of the printer 2.

More specifically, a charging unit 5, a light scanning unit 6, a development unit 7, a transfer unit 8, and a cleaning unit 9 are provided around the photoconductive drum 4 provided in the canter.

The charging unit 5 evenly charges the surface of the photoconductive drum 4. The light scanning unit 6 carries out scanning of a light image so as to write an electrostatic latent image on the evenly charged photoconductive drum 4. The development section 7 reproduces the electrostatic latent image written by the light scanning unit 6 with the developer.

The transfer unit 8 transfers the reproduced and recorded image on the photoconductive drum 4 onto a recording medium. The cleaning unit 9 removes the developer remaining on the photoconductive drum 4 so as to allow the photoconductive drum 4 to form a new image Note that, the residual developer removed by the cleaning unit 9 is then collected by a developer feeding section 10 of the development unit 7 for recycle. Note that, the image forming device of the present invention is not limited to the one including such a process for recycling the residual developer.

The following will explain the paper feeding unit 3. The paper feeding unit 3 includes plurality of paper feeding trays (recording medium feeding section) 11, 12, 13, and 14. By having these plural trays 11 through 14, the paper feeding unit 3 is capable of storing various kinds of papers as recording media. The paper feeding unit 3 may store these various papers by sorting them on the size basis, for example.

The image forming device 1 selects one tray among the paper feeding trays 11, 12, 13, and 14. Further, the image forming device 1 takes papers one by one from the selected tray so as to supply each paper between the photoconductive drum 4 and the transfer unit 8. Then, the transfer unit 8 transfers the reproduced and recorded image on the photoconductive drum 4 onto the supplied paper.

Here, the following will more minutely explain the paper feeding trays 11, 12, 13, and 14. The paper feeding tray 11 (a first recording medium feeding section) and the paper feeding tray 12 (a second recording medium feeding section) are provided in parallel with each other. Further, the paper feeding tray 13 is provided beneath the paper feeding trays 11 and 12, and the paper feeding tray 14 is provided beneath the paper feeding tray 13.

With the above arrangement of trays 14 is the most upstream tray provided on the carriage path 15, and 11 is downstream of trays 13 and 14.

Further, the paper feeding tray 13 and the paper feeding tray 14 have substantially the same paper storing capacity. Further, the paper feeding tray 11 and the paper feeding tray 12 each have a larger capacity than that of the paper feeding tray 13 or the paper feeding tray 14.

Further, the paper feeding unit 3 includes a first carriage path 15 and a second carriage path 16 for carrying the papers stored in the paper feeding trays 11, 12, 13 and 14 toward the printer 2. Note that, the first carriage path 15 carries the papers stored in the paper feeding trays 11, 13 and 14 toward the printer 2, and the second carriage path 16 carries the papers stored in the paper feeding tray 12 toward the printer 2.

Further, the first carriage path 15 extends along a frame 17 of the paper feeding unit 3 in a vertical direction. Meanwhile, the second carriage path 16 extends along a frame 17 in a horizontal direction.

Therefore, in the paper feeding unit 3, the paper feeding trays 11 through 14, the first carriage path 15, and the second carriage path 16 are effectively disposed, thus realizing reduction in area of the paper feeding unit 3.

Note that, when setting papers in the respective paper feeding trays 11 through 14, the user pulls out the target paper feeding tray (one of 11, 12, 13 and 14) to the front of the main body of the image forming device 1 (out of the plane of the figure) and feed the papers therein.

Incidentally, in case where a paper jammed in the first carriage path 15, the user rotates a guide 15*a* (denoted by diagonal lines) included in the first carriage path 15 to the left of the user (to the left of the figure) on the axis on the far side of the paper feeding unit 3 with respect to the user. This operation allows the user to remove the paper caught in the first carriage path 15. Note that, this removal operation uses an originally provided working space between the first carriage path 15 and the frame 17.

Further, in case where a paper jammed in the second carriage path 16, the user rotates a guide 16*a* (denoted by diagonal lines) included in the second carriage path 16 downward, on the axis on the far side of the paper feeding unit 3 with respect to the user. This operation allows the user to remove the paper caught in the first carriage path 16. Note that, this removal operation is carried out after the user obtains a working space under the second carriage path 16 by pulling out the paper feeding tray 11 and the paper feeding tray 12 disposed in parallel, in a direction toward the user.

Note that, in the foregoing arrangement, the guide 15*a* included in the first carriage path 15 is rotated to the left of the user on the axis on the far side of the paper feeding unit 3 with respect to the user. However, it may also be arranged so that the guide 15*a* is rotated to the left on its bottom end portion, together with a left end portion of the paper feeding unit 3 so as to open the first carriage path 15.

Further, the user simultaneously pulls out both the paper feeding tray 11 and the paper feeding tray 12 in the image forming device 1 of the present embodiment; however, the present invention is not limited to this arrangement but may also be arranged so that the user individually pulls out the respective paper feeding trays. In this case, the user can obtain the working space under the second carriage path 16 for removing the paper caught in the second carriage path 16 by pulling out the paper feeding tray 11 toward the user.

Next, the following will specifically explain the relation between the paper feeding tray 11 and the paper feeding tray 12 provided in parallel.

As shown in FIG. 1, the paper feeding tray 11 is greater in unit size than the paper feeding tray 12. This is because the paper feeding tray 11 and the paper feeding tray 12 store different size of papers. Also, this arrangement ensures a larger working space for removing the paper caught in the second carriage path 16.

Namely, when the paper feeding tray 11 is provided with a large width, the second carriage path 16 for carrying and supplying a paper from the paper feeding tray 12 toward the printer 2 inevitably becomes long. Therefore, when a paper is caught in the second carriage path 16, the user can extensively open the second carriage path 16.

Further, since the paper feeding tray 11 is greater in unit size than the paper feeding tray 12, the width of the opening space of the second carriage path 16 will be greater than the length of the paper supplied from the paper feeding tray 12. Thus, the user can easily find the paper caught in the second carriage path 16 in the opening space of the second carriage path 16.

Next, the following will explain a measure to be taken in case of a paper carriage error during the paper supply from the paper feeding tray 11.

The carriage path between the paper feeding tray 11 and the printer 2 is provided by passing through the first carriage path 15. This is because, when the paper is supplied from the paper feeding tray 11 to the printer 2 through the second carriage path 16, the first carriage path 15 and the second carriage path 16 are required to be merged immediately before the printer, and this complicates the layout of the carriage path.

The complication of the layout destabilizes the paper feeding from the paper feeding tray 11 to the printer 2, and also complicates the removal operation for paper jam since the user has to take out the paper by opening the vicinity of the merging section of the carriage path. If the worst happens, the paper is torn off before the user takes it out, and a piece of the paper would be left in the carriage path, and would cause a malfunction.

Therefore, the paper is supplied from the paper feeding tray 11 to the printer 2 via the first carriage path 15 in the present embodiment so as to simplify the merging layout of the first carriage path 15 and the second carriage path 16. This configuration allows the user to widely open a part of the first carriage path 15, and to easily remove the paper caught therein.

Figure 2:
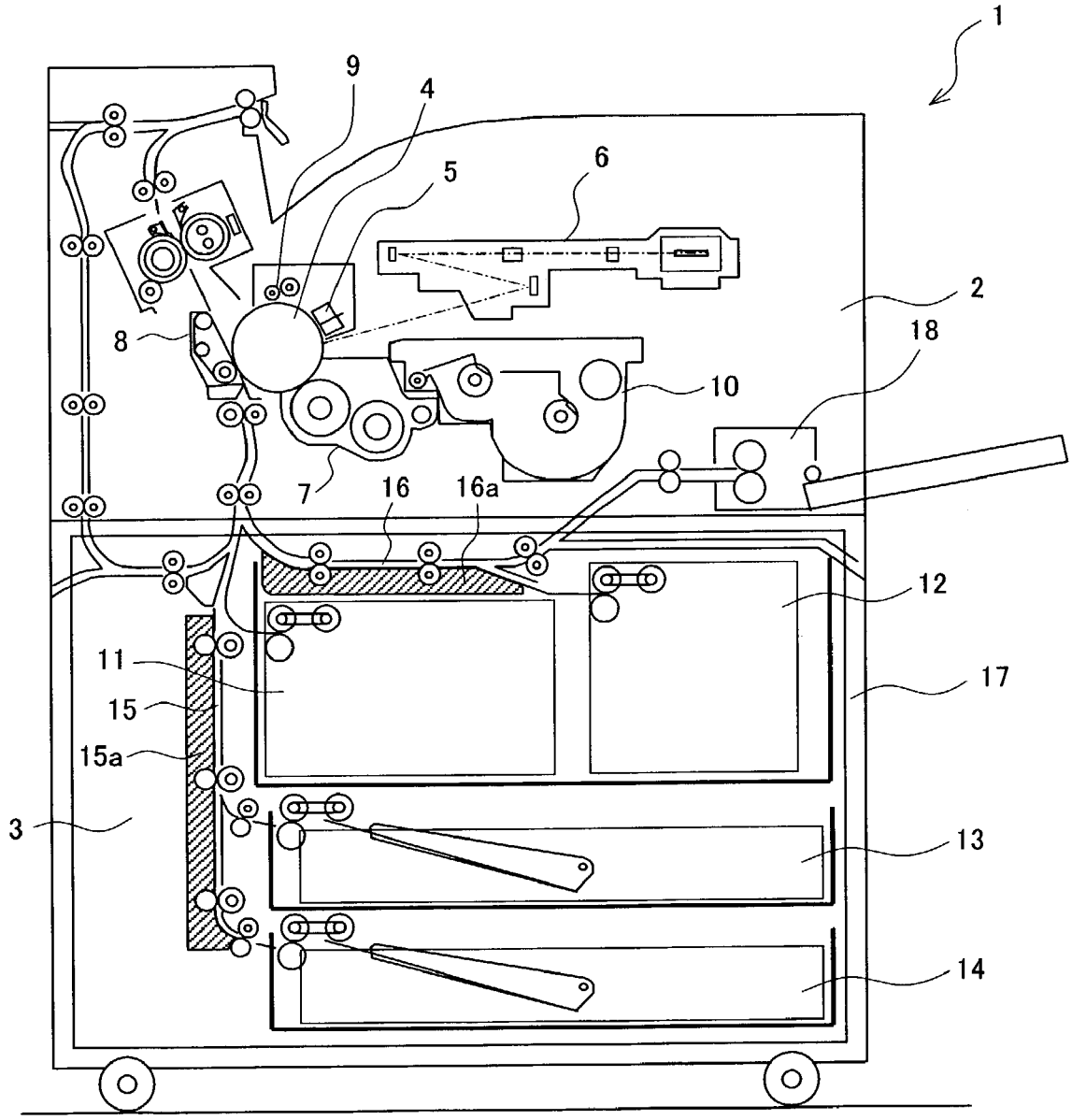
FIG. 2 is a cross-sectional view showing the image forming device of FIG. 1 provided with a manual paper feeding unit.

Next, the following will explain a variation example of the second carriage path 16. As shown in FIG. 2, a manual paper feeding unit (the third recording medium feeding section, recording medium feeding section) 18 may be provided on the upstream side of the second carriage path 16. The manual paper feeding unit 18 stores a relatively small quantity of papers. The manual paper feeding unit 18 can be additionally provided as an optional system upon user's demand after the delivery of the image forming device 1. The manual paper feeding unit 18 may otherwise be included in the image forming device 1 at the time of manufacturing or delivery, according to the market requests.

The manual paper feeding unit 18 is more suitable for storing special papers since it allows easy setting and/or exchange of papers. However, assuming that the manual paper feeding unit 18 stores various materials or sizes of papers, the paper feeding condition of the manual paper feeding unit 18 can be unstable compared to the paper feeding tray 11, 12, 13 or 14. Particularly, when the manual paper feeding unit 18 is provided with a paper out of the recommended paper range which is previously set for the manual paper feeding unit 18, the paper is more likely to get caught in the carriage path.

Figure 3:
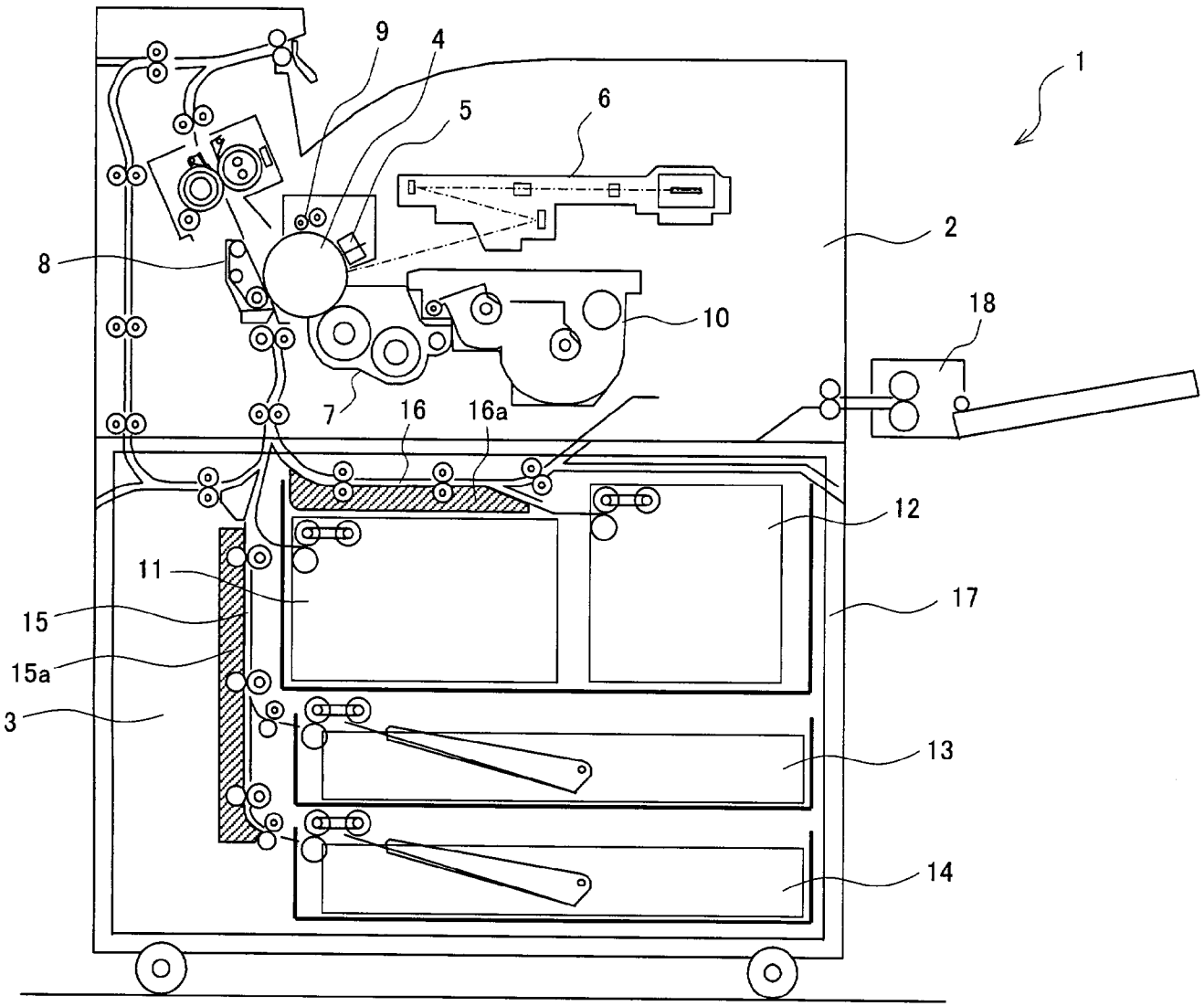
FIG. 3 is a cross-sectional view showing a slide-out state of the manual paper feeding unit of FIG. 2.

To cope with this problem, the manual paper feeding unit 18 is supported at the respective ends by such as a guide rail provided in the frame of the main body of the image forming device 1, while being slidable with the ends. Namely, as shown in FIG. 3, the manual paper feeding unit 18 can be pulled out from the right side of the image forming device 1 to the right in the figure so as to widely open the carriage path between the manual paper feeding unit 18 and the second carriage path 16. Further, after the removal operation of the paper, the manual paper feeding unit 18 can easily be brought back to the original state to be ready for general operation.

Figure 4:
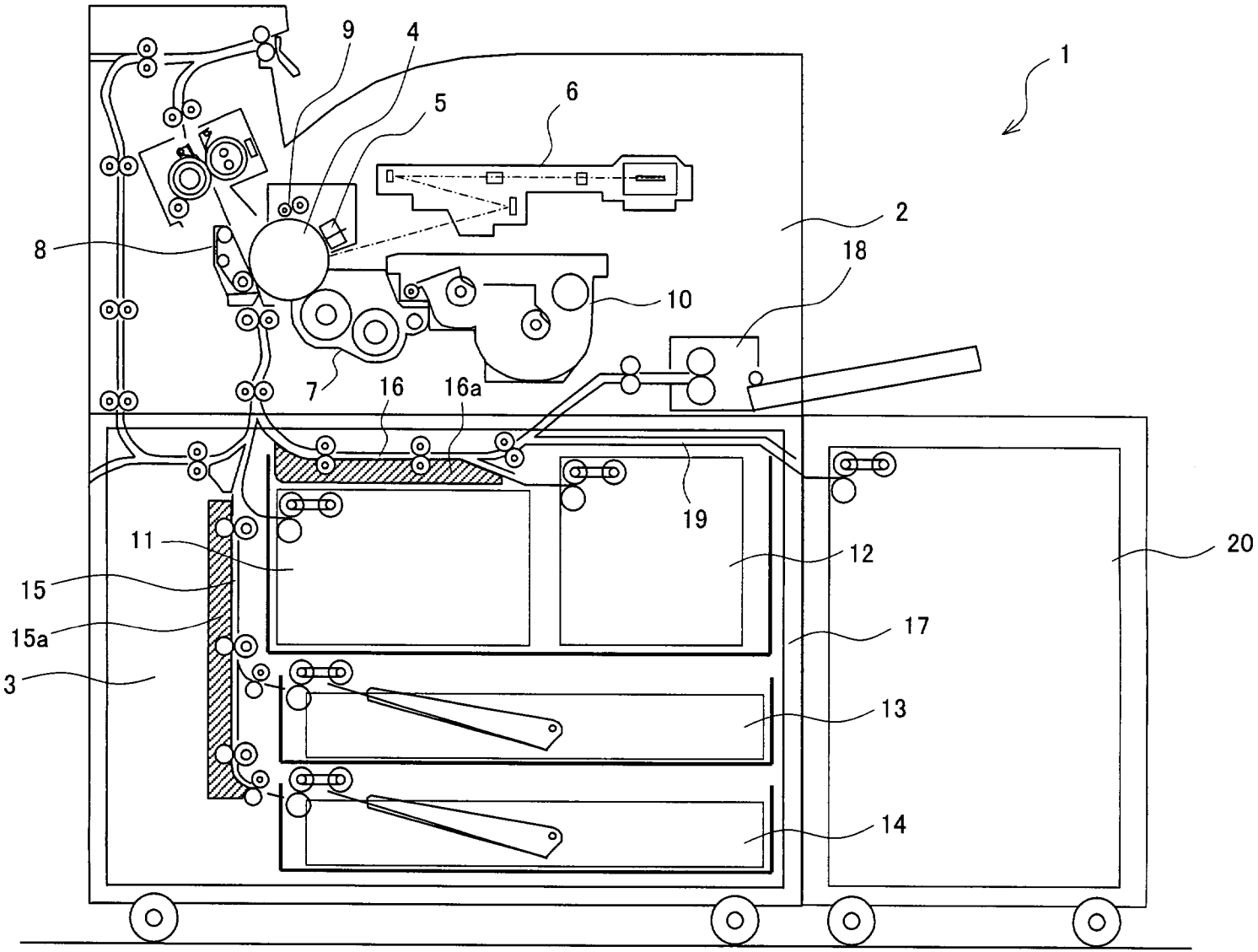
FIG. 4 is a cross-sectional view showing the image forming device of FIG. 1 provided with a large capacity paper feeding unit.

Further, as shown in FIG. 4, a paper feeding unit (a third recording medium feeding section, recording medium feeding section) 20 may be provided on the upstream side of the carriage path 16 by being connected to the right side of the image forming device 1 and the paper feeding unit 3. The paper feeding unit 20 has a larger paper capacity compared to the paper feeding trays 11 through 14. A paper supplied from the paper feeding unit 20 is lead to the printer 2 by passing through the third carriage path 19 and the second carriage path 16.

Incidentally, when a conventional image forming device including only one main carriage path is optionally provided with a paper feeding unit having a large capacity, the paper feeding unit is required to be placed on a position close to the main carriage path, i.e., on the main carriage path side of the image forming device. In this arrangement, the paper feeding unit interferes maintenance work with respect to the main carriage path.

In contrast, even when optionally adding the paper feeding unit 20, the image forming device 1 of the present embodiment can carry the paper from the paper feeding unit 20 to the printer without using the first carriage path 15. Therefore, the paper feeding unit 20 may be provided on a side opposite to the side having the first carriage path 15.

Thus, the paper feeding unit 20 does not interfere the maintenance work by opening the first carriage path 15 when the paper is caught in the first carriage path 15. In this view, the image forming device 1 of the present embodiment has an advantage compared to a conventional image forming device.

As described, the image forming device 1 of the present embodiment includes the first carriage path 15 which carries the papers from the paper feeding tray 11 to the printer 2, and the second carriage path 16 which carries the papers from the paper feeding tray 12 to the printer 2, and the first carriage path 15 and the second carriage path 16 individually carry the papers to the printer 2.

Namely, since the image forming device 1 of the present embodiment is arranged so that the first carriage path 15 and the second carriage path 16 individually carry papers to the printer 2, the carriage path extending from one of the paper feeding trays does not have to merge with the carriage path extending from another one of the paper feeding trays. Accordingly, the carriage path to the printer 2 can be simplified and the paper jam in the carriage path can be reduced.

Further, even if paper jam occurs in the first carriage path 15 or in the second carriage path 16, the user can easily remove the paper caught therein, since each path is made as a simple structure without the merging point to each other.

Further, the image forming device 1 of the present embodiment is arranged so that the first carriage path 15 carries a recording medium from a plurality of paper feeding trays 11, 13 and 14, and the second carriage path 16 carries a recording medium from a plurality of paper feeding trays 12, 18 and 20.

With this arrangement, the first carriage path 15 and the second carriage path 16 carry papers from a plurality of paper feeding trays. Here, by setting different kinds of papers in the plurality of paper feeding trays, it is possible to carry more kinds of papers to the printer 2 via the first carriage path 15 and the second carriage path 16.

Further, the image forming device 1 of the present embodiment is arranged so that the first and second carriage paths 15 and 16 extend from the printer 2 by forming a right angle.

Here, a general image forming device is often provided with a housing having a substantially rectangular shape, and a paper feeding tray is also provided with a housing having a substantially rectangular shape. Therefore, when a plurality of paper feeding trays are provided in an image forming device, a gap between each of the paper feeding trays and a gap between the plurality of paper feeding trays and the wall of the image forming device are orthogonal to each other in many cases.

Thus, the present embodiment is arranged so that, particularly, the first carriage path 15 and the second carriage path 16 extend from the printer 2 by forming a right angle.

More specifically, this arrangement allows the first carriage path 15 to be provided along the gap between the plurality of paper feeding trays and the wall of the image forming device, and allows the second carriage path 16 to be provided between each of the paper feeding trays.

Therefore, it is possible to provide the first carriage path 15 and the second carriage path 16 by effectively using space in the image forming device 1.

Further, the image forming device 1 of the present embodiment is arranged so that the paper feeding tray 11 and the paper feeding tray 12 are disposed in parallel with each other, and the second carriage path 16 carries a paper from the paper feeding tray 12 to the printer 2 beyond the paper feeding tray 11, and the second carriage path 16 also caries a paper from the manual paper feeding unit 18 and the paper feeding unit 20 to the printer.

With this arrangement, the second carriage path 16 carries a paper stored in the paper feeding tray 12 to the printer 2 beyond the paper feeding tray 11. Further, the second carriage path 16 and the first carriage path 15 are disposed in parallel with each other.

This arrangement allows the user to open the space under the second carriage path 16 by pulling out the paper feeding tray 11 from the image forming device 1. On this account, the user can easily carry out a maintenance work such as removal of a paper caught in the second carriage path.

Further, with the foregoing arrangement, the second carriage path 16 also carries a paper stored in the manual paper feeding unit 18 or the paper feeding unit 20. Therefore, it is possible to provide an image forming device more accommodated to user demands.

Further, the image forming device 1 of the present embodiment is arranged so that the manual paper feeding unit 18 or the paper feeding unit 20 is provided while being slidable with respect to the main body of the image forming device 1.

This arrangement allows the user to slide out the manual paper feeding unit 18 or the paper feeding unit 20 so as to separate them from the main body of the image forming device 1. Thus, when the paper carried from the manual paper feeding unit 18 or the paper feeding unit 20 gets caught in the second carriage path 16, the user can easily carry out a maintenance work of the second carriage path 16 by sliding out the manual paper feeding unit 18 or the paper feeding unit 20.

Further, the image forming device 1 of the present embodiment is arranged so that the paper feeding tray 11 has a wider width than that of the paper feeding tray 12.

As described, the image forming device 1 is arranged so that the second carriage path 16 carries a paper stored in the paper feeding tray 12 to the printer 2 beyond the paper feeding tray 11, and therefore the length of the opening space of the second carriage path 16 after the removal of the paper feeding tray 11 is substantially equal to the width of the paper feeding tray 11. Thus, since the paper feeding tray 11 has a wider width than that of the paper feeding tray 12, it is possible to provide a longer opening space of the second carriage path 16 after the removal of the paper feeding tray 11. This allows the user to obtain sufficient space for the maintenance work such as removal of a paper caught in the second carriage path 16.

Further, the image forming device of the present embodiment may be arranged so that the first carriage path carries a recording medium from a plurality of recording medium feeding sections including the first recording medium feeding section, and the second carriage path carries a recording medium from a plurality of recording medium feeding sections including the second recording medium feeding section.

With this arrangement, the first carriage path and the second carriage path carry papers from a plurality of recording medium feeding sections. Here, by setting different kinds of recording medias in the plurality of recording medium feeding sections, it is possible to carry more kinds of recording media to the image forming section via the first carriage path and the second carriage path.

Further, the image forming device of the present embodiment may be arranged so that the first and second carriage paths extend from the image forming section by forming a right angle.

Here, a general image forming device is often provided with a housing having a substantially rectangular shape, and the recording medium feeding section is also provided with a housing having a substantially rectangular shape. Therefore, when a plurality of recording medium feeding sections are provided in an image forming device, a gap between each of the recording medium feeding sections and a gap between the plurality of recording medium feeding sections and the wall of the image forming device are orthogonal to each other in many cases.

Thus, the present embodiment may be arranged so that, particularly, the first carriage path and the second carriage path extend from the image forming section by forming a right angle.

More specifically, this arrangement allows the first carriage path to be provided along the gap between the plurality of recording medium feeding sections and the wall of the image forming device, and allows the second carriage path to be provided between each of the recording medium feeding sections.

Therefore, it is possible to provide the first carriage path and the second carriage path by effectively using space in the image forming device.

Further, the image forming device of the present embodiment may be arranged so that the first and second recording medium feeding sections are disposed in parallel with each other, and the second carriage path carrying a recording medium stored in the second recording medium feeding section to the image forming section beyond the first recording medium feeding section.

With this arrangement, the second carriage path carries a recording medium stored in the second recording medium feeding section to the image forming section beyond the first recording medium feeding section. Further, the second carriage path and the first carriage path are disposed in parallel with each other.

This arrangement allows the user to open the space under the second carriage path by pulling out the first recording medium feeding section from the image forming device. On this account, the user can easily carry out a maintenance work such as removal of a recording medium caught in the second carriage path.

Further, the image forming device of the present embodiment may be arranged so that the second carriage path carries a recording medium stored in a third recording medium feeding section to the image forming section.

With the foregoing arrangement, the second carriage path carries not only a recording medium stored in the second recording medium feeding section but also a recording medium stored in the third recording medium feeding section. This third recording medium feeding section can be a manual feeding unit capable of setting various kinds of recording media, or a recording medium feeding unit capable of containing a large amount of recording media. With this arrangement, it is possible to provide an image forming device more accommodated to user demands.

Further, the image forming device of the present embodiment may be arranged so that the third recording medium feeding section is provided while being slidable with respect to a main body of the image forming device.

This arrangement allows the user to slide out the third recording medium feeding section so as to pull it out of the main body of the image forming device. Thus, when the recording medium carried from the third recording medium feeding section gets caught in the second carriage path, the user can easily carry out a maintenance work of the second carriage path by sliding out the third recording medium feeding section.

Further, the image forming device of the present embodiment may be arranged so that the first recording medium feeding section has a wider width than that of the second recording medium feeding section.

More specifically, the image forming device is arranged so that the second carriage path extends beyond the first recording medium feeding section, and therefore the length of the opening space of the second carriage path after the removal of the first recording medium feeding section is substantially equal to the width of the first recording medium feeding section. Thus, since the first recording medium feeding section has a wider width than that of the second recording medium feeding section, it is possible to provide a longer opening space of the second carriage path after the removal of the first recording medium feeding section. This allows the user to obtain sufficient space for the maintenance work such as removal of a recording medium caught in the second carriage path.

Note that, the image forming device of the present invention may also be arranged so that the image forming device includes an image forming section for carrying out image forming on a recording medium; a first carriage path for carrying a recording medium stored in a first recording medium feeding section to the image forming section; and a second carriage path for carrying a recording medium stored in a second recording medium feeding section to the image forming section, wherein each of the first and second carriage paths includes at least one recording medium feeding section on the downstream side of the carriage path.

With this arrangement, a plurality of common carriage paths are provided for leading a recording medium from a plurality of recording medium feeding sections to the image forming section. More specifically, the respective carriage paths for supplying a recording medium from a plurality of recording medium feeding sections to the image forming section are unified as a common carriage path, and therefore, even when a paper carriage error occurs immediately before the image forming section, the user can easily carry out removal operation of the paper caught in the carriage path. Further, this arrangement realizes the unification of the respective carriage paths from the plurality of recording medium feeding sections in the limited device space of the image forming device, thus realizing downsizing of the device and minimization of the installation area.

The image forming device of the present invention may be arranged so that the first and second carriage paths are substantially perpendicular to each other, and provided by starting from the image forming section.

With this arrangement, the plural common carriage paths are provided to be perpendicular to each other. On this account, even when the image forming device includes a plurality of recoding medium feeding sections, the plurality of common carriage paths can be constructed within the unit space with an effective layout. Thus, the installation area can be reduced to a minimum even when the system is constructed by providing an image forming section on an upper portion of the image forming device.

Further, the image forming device of the present invention may be arranged so that the image forming device includes an image forming section for carrying out image forming on a recoding medium; first and second recording medium feeding sections provided in parallel for supplying a recording medium to the image forming section; and a carriage path for carrying the recording medium from one of the recording medium feeding sections to the image forming section beyond another one of the recording medium feeding sections, wherein the carriage path further carries a recording medium supplied from a third recording medium feeding section to the image forming section.

This arrangement is provided with a carriage path for carrying a recording medium from one of the recording medium feeding sections to the image forming section beyond another one of the recording medium feeding sections, and also newly provided with a third recording medium feeding section on the downstream side of the carriage path. Thus, this arrangement allows storage of various sizes of papers, and also provides an environment for storing a large quantity of frequently-used papers, even in the limited installation area.

The image forming device of the present invention may be arranged so that the carriage path for carrying a recording medium from one (first) of the recording medium feeding sections to the image forming section beyond another (second) one of the recording medium feeding sections is provided above the second recording medium feeding section to be in parallel with the second recording medium feeding section, and the third recording medium feeding section can be slide-out with respect to the image forming device in an extended direction of the carriage path.

This arrangement is newly provided with a third recording medium feeding section on the downstream side of the carriage path for carrying a recording medium from one of the recording medium feeding sections provided in parallel to the image forming section beyond another one of the recording medium feeding sections, and the third recording medium feeding section can be slide-out in an extended direction of the carriage path. On this account, even when a recording medium gets caught in the third recording medium feeding section due to a paper carriage error, the user can remove the recording medium with an easy operation.

Further, the image forming device of the present invention may be arranged so that, among the plural recording medium feeding sections provided in parallel with each other, the one close to a carry-in entrance of the image forming section has a wider width than that of the one away from the carry-in entrance of the image forming section.

With this arrangement, by providing a wide width to the recording medium feeding section close to the carry-in entrance of the image forming section, the carriage path extending from another recording medium feeding section to the image forming section can be set relatively long. Therefore, even when a paper gets caught due to a carriage error, the carriage path can be widely opened, and the user can easily carry out removal of the paper for recovering the device.

Further, the image forming device of the present invention may be arranged so that the image forming device includes at least one recording medium feeding section provided under the plural recording medium feeding sections disposed in parallel, and among the plural recording medium feeding sections disposed in parallel, the one close to the carry-in entrance of the image forming section uses a common carriage path through the image forming section with the recording medium feeding section provided under the plural recording medium feeding sections disposed in parallel.

With this arrangement, among the plural recording medium feeding sections disposed in parallel, the one close to the carry-in entrance of the image forming section uses a common carriage path with the at least one recording medium feeding section provided under the plural recording medium feeding sections disposed in parallel. More specifically, the carriage path from the respective recording medium feeding sections to the image forming section can easily be merged as a common carriage path. On this account, even when a recording medium is caught in the carriage path, the user can easily remove the paper by opening a part of the carriage path, thereby improving user operationality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming device for carrying out image forming by an image forming section with respect to a recording medium carried from a plurality of recording medium feeding sections, comprising:

first and second carriage paths, the plurality of recording medium feeding sections including first, second and third recording medium feeding sections, where the first and second recording medium feeding sections are disposed in parallel with each other, the first carriage path carrying a recording medium stored in the first recording medium feeding section to the image forming section; and the second carriage path carrying a recording medium stored in the second recording medium feeding section to the image forming section, wherein the first carriage path vertically extends along an inside of the frame of a paper feeding unit and the second carriage path horizontally extends along an inside of the frame of the paper feeding unit, respectively, the first carriage path and the second carriage path individually carry a recording medium to the image forming section, the third recording medium feeding section is provided on an upstream side of the second carriage path, and the second carriage path carries a recording medium stored in the third recording medium feeding section to the image forming section, and the third recording medium feeding section is provided on a side opposite to the first carriage path with respect to the first and the second recording medium feeding sections where the first and the second recording medium feeding sections are located between the third recording medium feeding section and the first carriage path.

2. The image forming device as set forth in claim 1, wherein:

the first carriage path carries a recording medium from a plurality of recording medium feeding sections including the first recording medium feeding section, and the second carriage path carries a recording medium from a plurality of recording medium feeding sections including the second recording medium feeding section.

3. The image forming device as set forth in claim 1, wherein:

the first and second carriage paths are formed so as to be vertical when meeting a carry-in entrance in a bottom of a housing of the image forming section.

4. The image forming device as set forth in claim 1, wherein:

the second carriage path carries a recording medium stored in the second recording medium feeding section to the image forming section beyond the first recording medium feeding section.

5. The image forming device as set forth in claim 4, wherein:

the first recording medium feeding section has a wider width than that of the second recording medium feeding section.

6. The image forming device as set forth in claim 1, wherein:

a recording medium stored in the third recording medium feeding section is carried from a third carriage path to the image forming section via the second carriage path.

7. The image forming device as set forth in claim 1, wherein:

the first and second carriage paths each have at least one paper feeding tray on upstream sides of the first and second carriage paths.

8. The image forming device as set forth in claim 7, wherein:

the first and second at least one paper feeding tray are disposed in parallel with each other, and one of the first and second recording medium feeding sections which is close to a carry-in entrance of the image forming section uses a common carriage path through the image forming section with the other one of the first and second recording medium feeding sections.

9. The image forming device as set forth in claim 1, wherein the first and second carriage paths are located along the inner surface of the frame.

10. The image forming device as set forth in claim 1, wherein:

the first carriage path and second carriage path meet the image forming section in a plane of a top of the frame of the paper feeding unit.

11. The image forming device as set forth in claim 1, wherein the frame of the paper feeding unit includes a top frame member below the image feeding section and wherein the first and second carriage paths begin to meet above a bottom of the top frame member.

12. The image forming device as set forth in claim 11, wherein the first carriage path and the second carriage path begin to meet below a top of the top frame member.

13. The image forming device of claim 11 wherein the top frame member is in a plane above the first and second recording medium feeding sections.

14. The image forming device as set forth in claim 1, wherein; the third recording medium feeding section is slidably provided with respect to the second carriage path.

15. The image forming device as set forth in claim 1, wherein, the third recording medium feeding section is a manual paper feeding unit or a large capacity paper feeding unit.

16. The image forming device as set forth in claim 1, wherein, the first carriage path has a first user rotating guide and the second carriage path has a second user rotating guide.

17. An image forming device for carrying out image forming by an image forming section with respect to a recording medium carried from a plurality of recording medium feeding sections, comprising:

first and second carriage paths, the plurality of recording medium feeding sections including first and second recording medium feeding sections disposed in parallel with each other, the first carriage path carrying a recording medium stored in the first recording medium feeding section to the image forming section; and the second carriage path carrying a recording medium stored in the second recording medium feeding section to the image forming section beyond the first recording medium feeding section, wherein the first carriage path vertically extends along the frame of a paper feeding unit and the second carriage path horizontally extends along the frame of the paper feeding unit, respectively, and the first carriage path and the second carriage path individually carrying a recording medium to the image forming section, wherein, there is provided a third recording medium feeding section on an upstream side of the second carriage path, and the second carriage path carries a recording medium stored in the third recording medium feeding section to the image forming section; wherein:

the third recording medium feeding section is provided while being slidable with respect to a main body of the image forming device, and wherein:

the third recording medium feeding section is provided on a side opposite to the first carriage path with respect to the first and the second recording medium feeding sections, where the first and the second recording medium feeding sections are located between the third recording medium feeding section and the first carriage path.

18. The image forming device as set forth in claim 17, wherein, the third recording medium feeding section is a manual paper feeding unit or a large capacity paper feeding unit.

19. The image forming device as set forth in claim 17, wherein, the first carriage path has a first user rotating guide and the second carriage path has a second user rotating guide.

20. An image forming device for carrying out image forming by an image forming section with respect to a recording medium carried from a plurality of recording medium feeding sections, comprising:

first and second carriage paths, the plurality of recording medium feeding sections including first, second and third recording medium feeding sections and at least one paper feeding tray, the first and second recording medium feeding sections being disposed in parallel with each other, and the at least one paper feeding tray being disposed under the first and second recording medium feeding sections, the first carriage path carrying recording media stored in the first recording medium feeding section and the at least one paper feeding tray to the image forming section, the second carriage path carrying a recording medium stored in the second recording medium feeding section to the image forming section, wherein the first carriage path extends in a vertical direction to and inside of a frame of a paper feeding unit and the second carriage path extends in a horizontal direction to and inside the frame of the paper feeding unit, the first carriage path and the second carriage path individually carry a recording medium to the image forming section, the third recording medium feeding section is provided on an upstream side of the second carriage path, and the second carriage path carries a recording medium stored in the third recording medium feeding section to the image forming section, and the third recording medium feeding section is provided on a side opposite to the first carriage path with respect to the first and the second recording medium feeding sections, where the first and the second recording medium feeding sections are located between the third recording medium feeding section and the first carriage path.

21. The image forming device as set forth in claim 20, wherein:

the second carriage path carries a recording medium stored in the second recording medium feeding section to the image forming section beyond the first recording medium feeding section.

22. The image forming device as set forth in claim 20, wherein:

a recording medium stored in the third recording medium feeding section is carried from a third carriage path to the image forming section via the second carriage path.

23. The image forming device as set forth in claim 20, wherein the first and second carriage paths are located along the inner surface of the frame.

24. The image forming device as set forth in claim 20, wherein:

the first carriage path and second carriage path meet the image forming section in a plane of a top of the frame of the paper feeding unit.

25. The image forming device as set forth in claim 20, wherein the frame of the paper feeding unit includes a top frame member below the image feeding section and wherein the first and second carriage paths begin to meet above a bottom of the top frame member.

26. The image forming device as set forth in claim 25, wherein the first carriage path and the second carriage path begin to meet below a top of the top frame member.

27. The image forming device of claim 25 wherein the top frame member is in a plane above the first and second recording medium feeding sections.

28. The image forming device as set forth in claim 20, wherein;

the third recording medium feeding section is slidably provided with respect to the second carriage path.

29. The image forming device as set forth in claim 20, wherein, the third recording medium feeding section is a manual paper feeding unit or a large capacity paper feeding unit.

30. The image forming device as set forth in claim 20, wherein, the first carriage path has a first user rotating guide and the second carriage path has a second user rotating guide.

31. An image forming device for carrying out image forming by an image forming section with respect to a recording medium carried from a plurality of recording medium feeding sections, comprising:

first and second carriage paths, the plurality of recording medium feeding sections including first and second recording medium feeding sections and at least one paper feeding tray, the first and second recording medium feeding sections being disposed in parallel with each other, and the at least one paper feeding tray being disposed under the first and second recording medium feeding sections, the first carriage path carrying recording media stored in the first recording medium feeding section and the at least one paper feeding tray to the image forming section, the second carriage path carrying a recording medium stored in the second recording medium feeding section to the image forming section beyond the first recording medium feeding section, wherein the first carriage path extends in a vertical direction to a frame of a paper feeding unit and the second carriage path extends in a horizontal direction to the frame of the paper feeding unit, the first carriage path and the second carriage path individually carry a recording medium to the image forming section, there is provided a third recording medium feeding section on an upstream side of the second carriage path, and the second carriage path carries a recording medium stored in the third recording medium feeding section to the image forming section, the third recording medium feeding section is provided while being slidable with respect to a main body of the image forming device, and the third recording medium feeding section is provided on a side opposite to the first carriage path with respect to the first and the second recording medium feeding sections, where the first and the second recording medium feeding sections are located between the third recording medium feeding section and the first carriage path.

32. The image forming device as set forth in claim 31, wherein, the third recording medium feeding section is a manual paper feeding unit or a large capacity paper feeding unit.

33. The image forming device as set forth in claim 31, wherein, the first carriage path has a first user rotating guide and the second carriage path has a second user rotating guide.

* * * * *